United States Patent [19]

Inoue

[11] 4,437,908

[45] Mar. 20, 1984

[54] METHOD OF TREATING A MAGNETIC MATERIAL

[75] Inventor: Kiyoshi Inoue, Tokyo, Japan

[73] Assignee: Inoue-Japax Research Incorporated, Yokohama, Japan

[21] Appl. No.: 195,928

[22] Filed: Oct. 10, 1980

[30] Foreign Application Priority Data

Oct. 13, 1979 [JP] Japan ..... 54-132130
Oct. 13, 1979 [JP] Japan ..... 54-132131

[51] Int. Cl.[3] ..... C21D 1/04
[52] U.S. Cl. ..... 148/108; 148/103
[58] Field of Search ..... 148/100, 101, 102, 103, 148/108, 120, 121

[56] References Cited

U.S. PATENT DOCUMENTS

| | | | |
|---|---|---|---|
| 3,281,289 | 10/1966 | Gordon et al. | 148/108 |
| 3,472,708 | 10/1969 | Schindler et al. | 148/108 |
| 3,477,883 | 11/1969 | Sery et al. | 148/121 |
| 3,792,452 | 2/1974 | Dixon et al. | 340/174 TF |
| 3,849,213 | 11/1974 | Baermann | 148/108 |

FOREIGN PATENT DOCUMENTS

| | | |
|---|---|---|
| 2732282 | of 0000 | Fed. Rep. of Germany . |
| 919953 | 11/1954 | Fed. Rep. of Germany . |
| 2002681 | 10/1969 | France . |
| 363376 | 12/1931 | United Kingdom . |

*Primary Examiner*—John P. Sheehan
*Attorney, Agent, or Firm*—Karl F. Ross; Herbert Dubno

[57] ABSTRACT

A method of treating a preshaped magnetic material wherein a mechanical vibration and/or a high-energy beam are applied to the material held in a magnetic field.

21 Claims, 3 Drawing Figures

FIG. 3
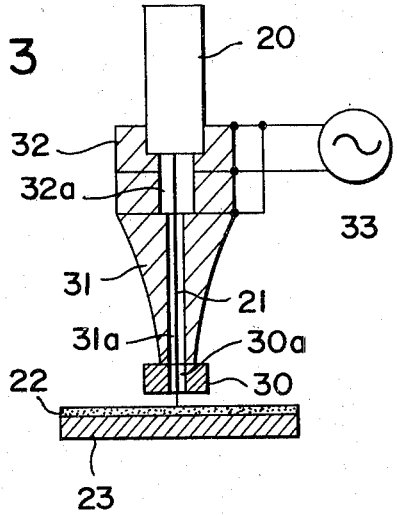
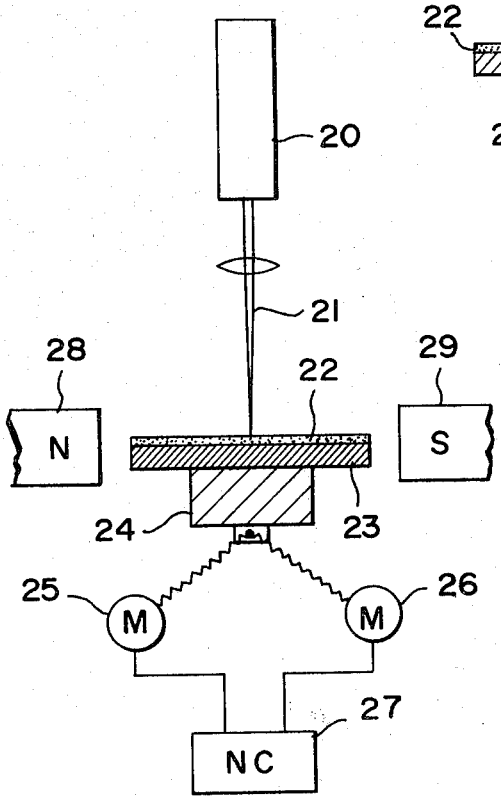
FIG. 2

METHOD OF TREATING A MAGNETIC MATERIAL

FIELD OF THE INVENTION

The present invention relates to the treatment of a magnetic material previously shaped by casting, swaging, forging, powder compaction, sintering or vapor deposition and, more particularly, to a method of treating such a magnetic material to improve its magnetic properties, e.g. maximum energy product.

BACKGROUND OF THE INVENTION

It is well known that cold working or swaging a cast magnetic material, for example, results in the development of a magnetic anisotropy therein and an improvement in its magnetic properties. It has been recognized that an alignment of the axis of easy magnetization then takes place in the working direction and leads to an increase in the "squareness" of the magnetic system. The working effect of swaging is, however, basically static and the extent of the improvement in magnetic properties thereby is relatively small. Furthermore, the conventional process entails, for achieving the desired end, the application of an elevated pressure which amounts generally to the order of tons/cm$^2$ and consequently makes essential a large-size facility including a costly high-pressure generator and accessory equipment.

It is also known that certain magnetic materials such as spinodal-decomposition type iron-chromium or iron-chromium-cobalt base magnetic alloys, after having been solution-treated, require an aging treatment which is conducted continuously or in a multiplicity of steps, necessitating a prolonged period of time, usually several to ten hours. The treatment has thus left much to be desired in efficiency and also requires strict temperature control which it is difficult to maintain and hence again requires relatively complex equipment and facilities.

OBJECTS OF THE INVENTION

It is, accordingly, an object of the present invention to provide an improved method of treating a preshaped magnetic material which is extremely efficient and reliable in imparting increased magnetic properties thereto.

SUMMARY OF THE INVENTION

These and other objects of the present invention are attained, in accordance with a first aspect thereof, with a method of treating a preshaped magnetic or ferromagnetic material, which method comprises placing the magnetic material in a magnetic field while imparting mechanical vibrational energy to the material. The vibration, which may be of a sonic frequency in excess of 100 Hz but is preferably of a frequency in an ultrasonic range preferably from 5 to 50 kHz but practically up to 500 kHz, is applied substantially in the same direction as or in the direction substantially perpendicular to, the direction in which the magnetic field is applied. The amplitude of the vibration applied to the material should preferably range between 1 and 50 microns, still more preferably between 1 and 15 microns, thus approaching the size of individual ferromagnetic domains in the material. The magnetic field strength should preferably range in excess of 1 kOe.

While the precise theory which describes the combined action of the mechanical oscillation and the magnetic field yielding the improved magnetic properties of the magnetic material has not yet been established, it is assumed that certain dynamic phenomena are developed among the random magnetic domains constituting the magnetic system in the body. It appears that the alternating shrinkage and expansion of each unit volume of the material repeated at the high frequency act to activate random or less oriented magnetic domains therein and to drive them progressively into substantially perfect alignment with the magnetic field applied externally.

Specifically, the method in this aspect of the invention is carried out preferably at an aging temperature or during a course of the aging treatment to which the material is ordinarily subjected for heat treatment, although the method may also be executed at a lower or room temperature, to develop an increase in the retentivity and magnetic energy product in the material.

An apparatus for carrying out the method in the first aspect of the invention comprises means for receiving a magnetic mateiral, means for applying a magnetic field to the material, and means for imparting a mechanical vibration to the material. The magnetic field means may comprise either an electromagnet or permanent magnet capable of generating the magnetic field preferably in excess of 1 KOe and advantageously associated with magnetic flux conductors for traversing magnetic fluxes of the field through the material in a direction perpendicular to or in parallel with the axis of the mechanical vibration. The vibration means may conveniently make use of a conventional ultrasonic vibrator assembly consisting of a transducer (e.g. a magnetostrictive element or a piezoelectric element) and an amplifying horn, the transducer being energized by a high-frequency power supply. The material receiving means may comprise a vessel consisting of a frame member and a pair of punches or support members slidably received in the frame member to define a chamber therein in which the material is held. Preferably, press means is provided to apply a relatively static pressure to the material in the chamber or on the support member. The mechanical vibration produced by the vibration means is then superimposed upon the static pressure to serve to produce a high-frequency periodic augmentation of the static pressure. The support member for receiving the magnetic material in case the latter is in the form of a thin film or membrane may be a belt on which the film or membrane is previously formed by vapor deposition.

Preferably, the apparatus further includes means for heating the magnetic material under the action of the mechanical vibration in the magnetic field at an aging or tempering temperature of the material.

In accordance with another aspect of the invention there is provided a method of treating a preshaped magnetic material for increasing the magnetic properties thereof, the method comprising: placing the magnetic material in a magnetic field, preferably in excess of 1 KOe, while applying a high-energy beam, e.g. laser (photons), electron, iron or a combination of electrons and ions, or a molecular beam. Preferably, a mechanical vibration of the type described is simultaneously applied to the magnetic material.

The magnetic material may conveniently be in the form of a film or membrane previously deposited by vapor deposition upon a substrate which may be in the form of a belt.

In an apparatus for carrying out the method in this aspect of the invention, a beam generator is juxtaposed with the magnetic material carried on the substrate or a support member to apply an irradiation of the high-energy beam on the magnetic material. Drive means may be provided to displace one or both of the beam generator and the substrate or the support member to allow the beam in a scanning manner to move on and throughly irradiate a given or the entire area of the magnetic material. To conduct the scanning operation efficiently and automatically, the drive means or motors may be controlledly driven in response to drive signals furnished from a numerical control (NC) unit.

BRIEF DESCRIPTION OF DRAWING

These and other objects, features and advantages of the present invention will become more readily apparent from the following description of certain embodiments thereof, taken with reference to the accompanying drawing in which:

FIG. 2 is an elevational view essentially schematic illustrating another embodiment of the invention applying beam energy to magnetic material in the form of a film deposited on a substrate and placed in a magnetic field; and FIG. 3 is an elevational view essentially in section diagrammatically illustrating a further embodiment of the invention using both a vibration energy and beam energy to magnetic material on a substrate.

SPECIFIC DESCRIPTION

Figure 1:
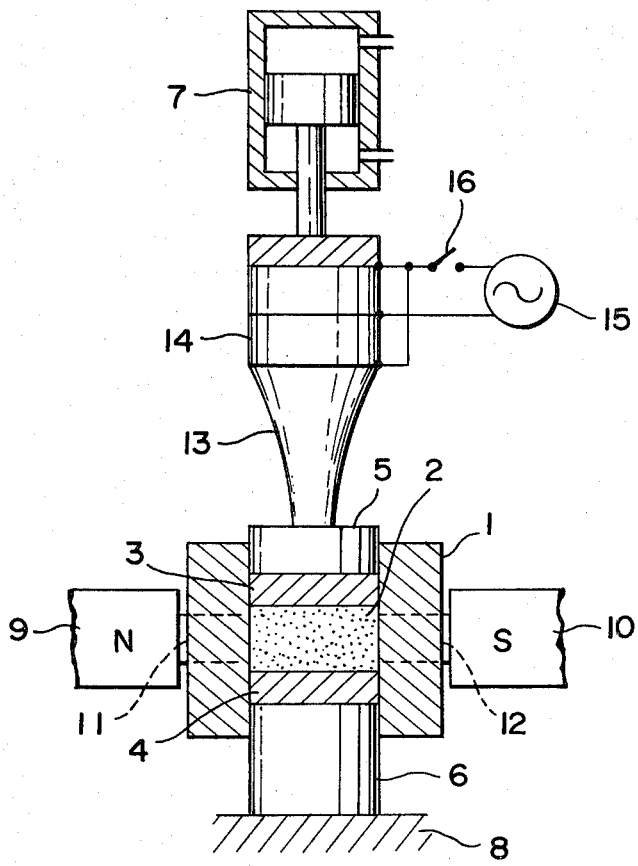
FIG. 1 is an elevational view partly in section diagrammatically illustrating one embodiment of the invention applying a vibration energy to a preshaped body of magnetic material pressed within a receptacle in a magnetic field.

Referring first to FIG. 1, a cylindrical frame member 1 constituting a treatment vessel is shown receiving a preshaped cylindrical body of magnetic material 2 between a pair of press disks 3 and 4 therein. The press disks 3 and 4 are slidably held within the frame member by an upper punch 5 and a lower punch or support member 6, respectively, which are partly received slidably within the frame member 1 to compress the magnetic body 2 therein. The upper punch 5 is urged downwardly by means of a hydraulic cylinder arrangement 7 to apply a downward static pressure to the magnetic body 2 via the disk 3 while the lower member 6 is mounted upon a base 8 or may be urged upwardly by a press unit similar to the cylinder 7 to apply an upward static pressure to the magnetic body 2 via the disk 4.

A pair of magnetic poles, an N-pole 9 and an S-pole 10, are disposed outside the frame member 1 and communicate with the magnetic body 2 respectively via magnetically permeable blocks 11 and 12 shown penetrating the frame member 1 to apply a magnetic flux (continuous or pulsed) to the body 2 in a direction perpendicular to the direction of the static pressure applied thereto.

The upper punch 5 is attached to the lower, converging end of an ultrasonic vibration horn 13 which has at its other end a transducer 14 connected to the piston of the cylinder arrangement 7. The transducer 14 is connected to a high-frequency power supply 15 via a switch 16.

The magnetic material 2 is a preshaped body (as distinguished from a mass of discrete particles) cast, swaged, forged, rolled, compacted or sintered previously.

In operation, the punch 5 is driven by the cylinder arrangement 7 to apply a relatively low static pressure to the body 2 received in the chamber defined by the frame member 1 and the disks 3 and 4. The magnetic poles 9 and 10 are activated to apply the magnetic field to the body 2. Then, the switch 16 is closed to connect the power supply 15 to the transducer 14. The ultrasonic vibration signal generated at the transducer 14 is amplified by the horn and transmitted via the punch 5 and the disk 3 to the magnetic body 2. An ultrasonic vibrational energy is thus imparted in superimposition upon the static pressure to the magnetic body 2 which is subjected to the magnetic field extending here perpendicular to the direction of the vibration.

The device of FIG. 1 may further include means for heating the magnetic material 2 subjected to the combined action of the magnetic field and the compressive vibration so far described. Such means may make use of a high-frequency induction heating coil mounted in the frame member 1 to surround the material 1 and energized by a power supply, and is operated to heat the material 1 at an aging temperature.

EXAMPLE

A magnetic body consisting by weight of 6% cobalt and 18% chromium and the balance iron cast, solution-treated and then aged in a plurality of steps down to 400° C. is treated with a device of the type illustrated in FIG. 1, using a static pressure of 1 to 3 kg/mm$^3$, a mechanical vibration of an amplitude of 6 to 10 microns and a frequency of 20 to 25 KHz and a magnetic field of 10 KOe. The body after the treatment for 13 minutes has a maximum energy product (B.H)max of 4.6 MGOe. A similar body without this treatment but simply age-treated in the usual manner to the end consuming a time period of 6 hours has a maximum energy product (B.H)max of 3.8 MGOe.

In FIG. 2 there is shown another embodiment of the invention in which a high-energy photon, electron, ion, molecule) beam is used, together with or without mechanical vibrations as described, to activate and treat a preshaped magnetic or ferromagnetic material so that an improved magnetic property develops therein.

The device shown includes a laser generator 20 designed to provide a high-intensity laser beam 21 of an output power of $10^3$ to $10^5$ watts/cm$^2$. The generator 20 is juxtaposed with a ferromagnetic or high-permeability magnetic material 22, here in the form of a film or membrane, deposited, e.g. by vapor deposition, on a substrate 23 in the form of a belt or plate to direct the focused high-energy laser beam 21 on a portion of the material 22. The substrate 23 is carried on a worktable 24 which is driven by a pair of motors 25 and 26 (e.g. each being a pulse motor or a DC motor equipped with an encoder) to displace the material 22 in an X-Y or horizontal plane. The X-axis motor 25 and the Y-axis motor 26 are operated by drive signals furnished from a numerial control (NC) unit 27 of convensional design. The NC unit has path data preprogrammed therein in the usual manner, the data being converted into the drive signals in the form of streams of pulses distributed into the X- and Y-axis displacement components so that the worktable 23 moves, say, in rectilinear parallel paths back and forth, relative to the focused laser beam 21, to present the entire area or a given area of the material 22 thoroughly to irradiation by the latter.

The magnetic material 22 on the substrate 23 is also subjected to a continuous or pulsed magnetic field of an intensity in excess of 1000 Oersted generated by a pair of magnetic poles, an N pole 28 and an S pole 29, provided by a permanent magnet or electromagnet. The NC-driven worktable 24 effectively moves the laser beam 21, in rectilinear parallel paths, in a scanning manner, back and forth across the material 22 between stored X- and Y-coordinate limits to incrementally irradiate the material 22 throughly over the entire or given area thereof. The rate of effective displacement of the laser beam 21 relative to the material 22 or the rate of irradiation may be, for example, 1 to 10 mm/sec or 0.1 to 1 sec/mm, when the laser beam 21 has an output power of $10^3$ to $10^5$ watts/cm$^2$. The time of uniform irradiation thus ranges between 0.1 and 1 second for any given area of the irradiation.

The electron-microscopic study of a preshaped ferromagnetic material treated by this method has shown that a markedly fine and uniform growth of crystals develops therein and an extremely high degree of anisotropy develops in its metallograph. It has been found that the treated material exhibits an increase by as much as 20% in the maximum energy product over the untreated material.

It has also be found that the size in diameter of the high-energy beam and its scanning speed can advantageously be adjusted to control the depth of treatment in the magnetic material practically at will. As a consequent, only a superficial portion of the material or a preselected portion toward inside thereof as desired can be selectively and uniformly treated. For example, the portion of a magnetic material mechanically cut or ground gives rise to a loss of the magnetic property and such portions can be selectively treated by the method to recover the magnetic property.

A further embodiment of the invention shown in FIG. 3 may be used again to treat a magnetic film or membrane 22 previously shaped or deposited on the substrate 23. The device shown includes a drive member 30 in the form of a perforated disk drivingly juxtaposed with the material 22 and attached at a driving end of a horn 31 having a central opening or passage 31*a*. The horn 31 has at its other end a piezoelectric or magnetostrictive transducer 32 which has likewise a central passage 32*a* and is energized by a high-frequency power supply 33. The laser generator 20 of the type previously described is seated on the shoulder in the passage 32*a* to direct the laser beam 21 through passage 31*a* and 30*a* on a portion of the material 22 deposited on the substrate 23 and held in the magnetic field. In this emodiment, the action of the ultrasonic mechanical activation generated by the assembly 30, 31, 32 and 33 is superimosed upon the action of the high-energy beam activation generated by the assembly 20. The substrate 23 may here too be carried by the worktable displaced in the manner described before to allow the material 22 to be treated in a scanning manner by the device.

What is claimed is:

1. A method of treating a preshaped magnetic material in the manner to improve its magnetic properties, comprising: placing said magnetic material in an essentially unidirectional magnetic field and, imparting mechanical vibrations to said magnetic material while said magnetic material is in said magnetic field and independently of the application of the magnetic field.

2. The method defined in claim 1 wherein said essentially unidirectional magnetic field has a field strength in excess of 1 KOe.

3. The method defined in claim 1 or claim 2 wherein said mechanical vibrations have a vibrational frequency in an ultrasonic range.

4. The method defined in claim 3 wherein the amplitude of said mechanical vibrations ranges between 1 and 15 microns.

5. A method as defined in claim 1 or claim 2, further comprising heating said magnetic material at a tempering temperature thereof while said mechanical vibrations are imparted to said magnetic material.

6. The method defined in claim 1 or claim 2 wherein said essentially unidirectional magnetic field is applied to said magnetic material in a direction substantially perpendicular to the direction of said mechanical vibrations.

7. The method defined in claim 1 or claim 2 wherein said essentially unidirectional magnetic field is applied to said magnetic material in a direction substantially in parallel with the direction of said mechanical vibrations.

8. A method of treating a preshaped magnetic material to improve its magnetic properties, comprising:

placing said magnetic material in a magnetic field while imparting mechanical vibrations to said material; and applying a static pressure in superimposition upon said mechanical vibrations to said material.

9. The method defined in claim 1, claim 2 or claim 8 wherein said magnetic material is a precast block.

10. The method defined in claim 1 claim 2, or claim 8 wherein said magnetic material is in the form of a film deposited on a substrate.

11. A method of treating a preshaped magnetic material to improve its magnetic properties, comprising:

placing said magnetic material in a magnetic field while imparting mechanical vibrations to said material; and applying a high-energy beam to said material while the latter is in said magnetic field.

12. The method defined in claim 1 wherein said beam is a laser beam.

13. A method of treating a preshaped magnetic material to improve its magnetic properties, comprising: placing said magnetic material in a magnetic field while applying a high-energy laser beam to said material.

14. The method defined in claim 13 wherein said laser beam has an output power of $10^3$ to $10^5$ watts/cm$^2$.

15. The method defined in claim 14 wherein said laser beam is applied for a period of 0.1 to 1 second.

16. A method as defined in claim 13, further comprising displacing said beam in a scanning manner over at least a preselected area of said material.

17. The method defined in claim 16 wherein said beam is displaced at a rate of 1 to 10 mm/sec.

18. The method defined in claim 13 wherein said material is in the form of a film previously deposited upon a substsrate.

19. The method defined in claim 13 wherein said material is a precast block.

20. A method as defined in claim 13, claim 14, claim 15, claim 16, claim 17, claim 18 or claim 19, further comprising:

imparting a mechanical oscillatory energy to said material in said magnetic field, simultaneously with the application of the energy of said beam.

21. The method defined in claim 8 or claim 11 wherein said magnetic field has a field strength in excess of 1 KOe.

* * * * *